US005647176A

United States Patent [19]

Milliken et al.

[11] Patent Number: 5,647,176

[45] Date of Patent: *Jul. 15, 1997

[54] CONSTRUCTION ASSEMBLY FOR CLOSURE STRUCTURE

[76] Inventors: Les Milliken, 101 S. McCall Rd.; K. Blair Milliken, 305 Gladstone Blvd., both of Englewood, Fla. 34223

[ * ] Notice: The term of this patent shall not extend beyond the expiration date of Pat. No. 4,926,605.

[21] Appl. No.: 508,543

[22] Filed: Jul. 28, 1995

Related U.S. Application Data

[63] Continuation of Ser. No. 301,714, Sep. 7, 1994, abandoned, which is a continuation of Ser. No. 2,073, Jan. 8, 1993, abandoned, which is a continuation of Ser. No. 852,929, Mar. 13, 1992, abandoned, which is a continuation of Ser. No. 521,593, May 10, 1990, abandoned, which is a continuation-in-part of Ser. No. 191,419, May 9, 1988, Pat. No. 4,926,605.

[51] Int. Cl.[6] ..... E04H 15/18

[52] U.S. Cl. ..... 52/63; 52/222; 160/392

[58] Field of Search ..... 52/63, 222, 202, 52/203; 160/391, 392, 395, 398, 399, 404

[56] References Cited

U.S. PATENT DOCUMENTS

| | | | |
|---|---|---|---|
| 4,074,811 | 2/1978 | Filak . | |
| 4,092,992 | 6/1978 | Huddle . | |
| 4,189,880 | 2/1980 | Ballin | 52/222 |
| 4,799,299 | 1/1989 | Campbell | 160/392 |
| 4,817,655 | 4/1989 | Brooks | 52/222 |

FOREIGN PATENT DOCUMENTS

| | | | |
|---|---|---|---|
| 1145921 | 5/1983 | Canada | 52/222 |
| 626844 | 3/1936 | Germany | 160/395 |

OTHER PUBLICATIONS

IATA Catalog: Awning Frames 1985–1986 Edition.

*Primary Examiner*—Michael Safavi

*Attorney, Agent, or Firm*—Gifford, Krass, Groh, Sprinkle, Patmore, Anderson & Citkowski, P.C.

[57] ABSTRACT

A construction assembly for closures, including awnings, canopies, boat coverings, signs and displays having a frame composed of aluminum and the like including channelled, joinable members preferably for assembly by welding into a frame, a covering material formed from a textile, and flexible trim pads for interlocking the covering material into the channels of the joinable members. The assembly includes staples to act as anchors to hold the material into place before forced insertion of the flexible fasteners. The joinable members may have a square, rectangular, round, or triangular shape when viewed in cross section. In one embodiment, the joinable members may have one or more cantilevered flanges suspended therefrom for framing or to provide for attachment to another structure or to provide support for other structures such as a light diffuser. This construction also improves the overall integrity of the member. In cross section, the joinable members have a round or a multi-sided configuration.

6 Claims, 3 Drawing Sheets

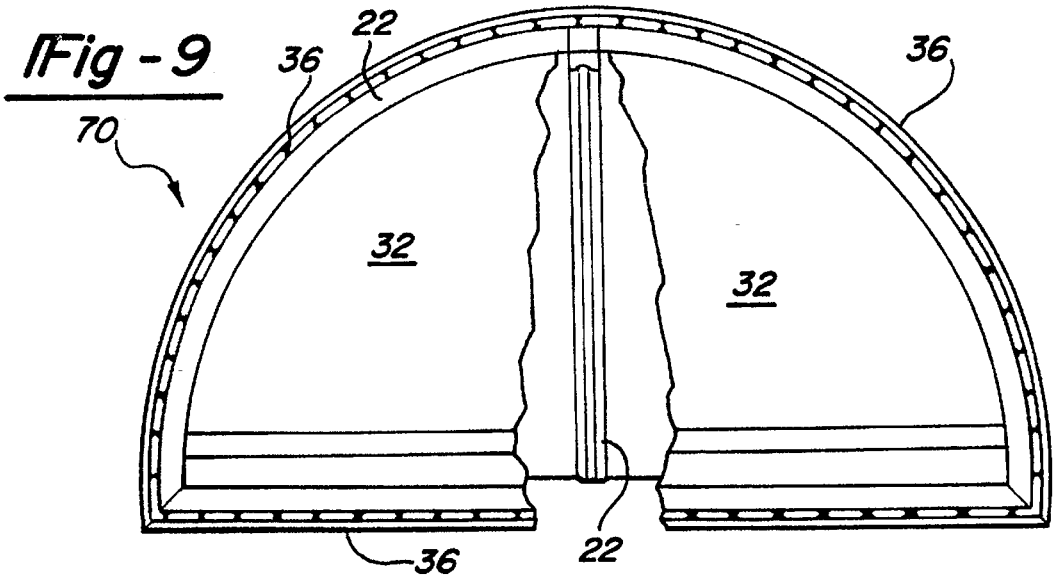
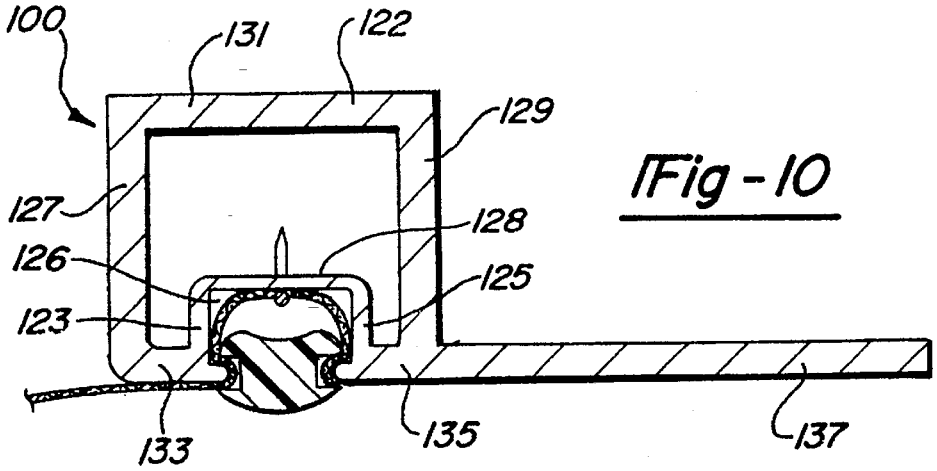
Fig-10
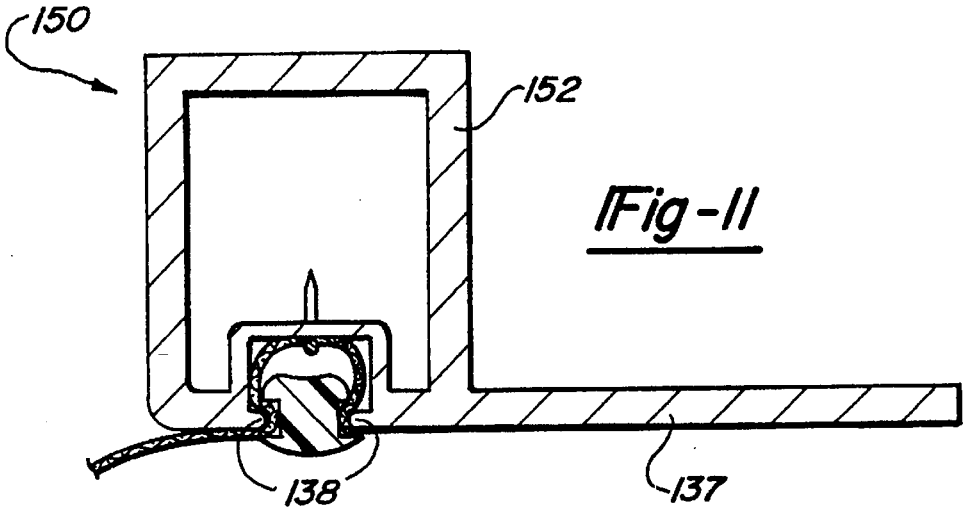
Fig-11

CONSTRUCTION ASSEMBLY FOR CLOSURE STRUCTURE

This is a continuation of U.S. application Ser. No. 08/301,714 filed Sep. 7, 1994, now abandoned, which is a continuation of U.S. application Ser. No. 08/002,073 filed Jan. 8, 1993, now abandoned, which is a continuation of U.S. application Ser. No. 07/852,929 filed Mar. 13, 1992, now abandoned, which is a continuation of U.S. application Ser. No. 07/521,593 filed May 10, 1990, now abandoned, which is a continuation-in-part of U.S. application Ser. No. 07/191,419 filed May 9, 1988, now U.S. Pat. No. 4,926,605.

BACKGROUND OF THE INVENTION

I. Field of the Invention

The present invention relates generally to construction assemblies for closure structures. More particularly, the present invention relates to a construction assembly for awnings, canopies, boat coverings, displays, signs and the like including a frame, a covering, and removable, flexible strips for interlocking the covering into the frame. An alternate embodiment includes an elongated cantilevered flange.

II. Description of the Relevant Art

Shading and closure structures, more particularly, awnings, canopies, boat coverings, displays, signs or the like, are typically provided with a frame fixed to a base or support structure and a covering material placed over the frame.

Conventionally, closures, particularly awnings and canopies, have one of two distinct constructions. The first construction, that typical in the United States, includes a frame composed of tubular steel or aluminum members shaped and welded together. Once the frame is established, material is stretched thereover and tied to the frame. This construction offers flexibility of form in that the tubular members can be bent to form closures having arcuate shapes. However, this construction suffers from an inefficient and less effective method for attaching the covering material to the frame.

The second construction, that typical in many European countries, includes a frame composed of substantially flat elongated members having slots which are attached to one another by mechanical fasteners. This structure is assembled at the factory largely because of the complexity of the fastening system and the covering is placed over the frame and is connected to the frame with staples or other fastening devices. Thereafter it is shipped to the installation site. The covering is placed over the frame and is connected to the frame with staples or other fastening devices. While this system offers the advantage of securely fitting the covering material to the frame, the elongated members themselves are not particularly structurally sound for all size structures. This elongated configuration frame system typically is effective only in smaller structures due to its general lack of structural integrity in supported or unsupported modes.

Accordingly, prior inventions have failed to eliminate the problems of inconvenience and lack of structural integrity commonly associated with construction assemblies for closures.

SUMMARY OF THE PRESENT INVENTION

The present invention is a construction assembly for closures including awnings, canopies, boat coverings, displays, signs and the like which includes a frame comprised of a number of elongated, joinable members, each member having a longitudinal channel provided therein, a flexible covering material formed from a textile or vinyl or a similar plastic, and a system for interlocking the covering material with the channels defined in the frame.

The system includes anchors for holding the material into the channels, such anchors being staples. Flexible, elongated trim pads are also provided and are force-fittable into the channels. The flexible, elongated trim pads seal the covering material to the frame in such a way that no wear occurs at the anchors and water and dirt is usually kept out of the interior of the canopy or awning.

The frame may be composed of a metal, preferably aluminum or steel, whereas the flexible trim is preferably composed of a polymerizable material such as a soft vinyl or rubber. The frame is preferably welded together, although riveted fasteners may be used.

In cross section, the joinable members may be one of two preferred configurations. In the first configuration, the cross section of the member is multi-sided and has a hollow core. In the second configuration, the cross section of the member is substantially round and also has a hollow core.

In an alternate embodiment, one or more joinable members may have provided thereon one or more elongated cantilevered flanges to provide a method of framing or to provide a method of attaching the member to another structure such as a cobiner, a wall or a roof. The flanges may also be arranged to hold a plastic or metal light diffuser (sometime called an "eggcrate").

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which:

FIG. 9 is a sectional view of a construction assembly according to the present invention employing the frame structure embodied in FIG. 4;

FIG. 10 is an assembled view showing the elements according to an alternate embodiment of the present invention; and FIG. 11 shows an alternate rectangular cross-sectional shape for the member.

DETAILED DESCRIPTION OF THE PREFERRED EMBODIMENTS OF THE INVENTION

FIGS. 1–11 show preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
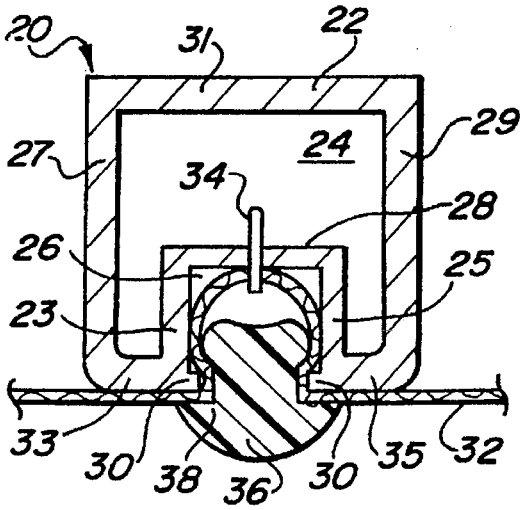
FIG. 1 is an assembled view showing the elements of a preferred embodiment of the present invention shown in cross section.

With reference to FIG. 1, there is shown in cross section an assembled view of a preferred construction of the present invention The assembly, generally indicated by 20, comprises a substantially hollow, square-shaped channelled member 22. On one side of the channelled member 22 is defined a channel 26 having therein a channel base 28 and a pair of opposing flanges 30 provided at the mouth of the channel 26. The channel 26 is defined by a first channel wall 23 and a second channel wall 25 whereby the channel base 28 is disposed therebetween. The outer structure of the channeled member 22 includes a first side member 27, a second side member 29 and a base member 31 disposed therebetween Interconnecting the first channel wall 23 and the first side member 27 is a first adjacent wall 33. Interconnecting the second channel wall 25 and the second side member 29 is a second adjacent wall 35. The channelled member 22 may be composed of aluminum or steel, although conceivably its composition may be of a plastic or vinyl.

A portion of a covering material 32 is shown fitted in place on the channelled member 22. Some of the material 32 is gathered into the channel 26. The material 32 is primarily anchored into place by a staple 34 which anchors the material 32 to the base 28 of the channel 26. Conceivably, the staple 34 may be substituted by a conventional fastener such as a rivet or a screw (not shown).

A flexible trim pad 36 is provided having a pair of longitudinal slots 38 defined on a plane therein and provided on opposite sides of the pad 36. The pad 36 is preferably composed of a polymerizable material such as a soft plastic or rubber. The pliable nature of the pad 36 allows for slots 38 to interlock with the flanges 30 of the channelled member 22, thereby interlocking the material 32 therein. This construction provides for a tight seal, thereby reducing the possibility of the material 32 shifting relative to the channelled member 22. This close tolerance also usually prevents water or dirt from entering the channel 26

In addition, and again because of its pliable nature, the pad 36 may also be readily removed for replacement of the material 32.

To provide greater structural integrity, the channelled member 22 has an inner chamber 24 defined therein. Two or more chambers may alternatively be used as desired to provide greater structural integrity.

Figure 2:
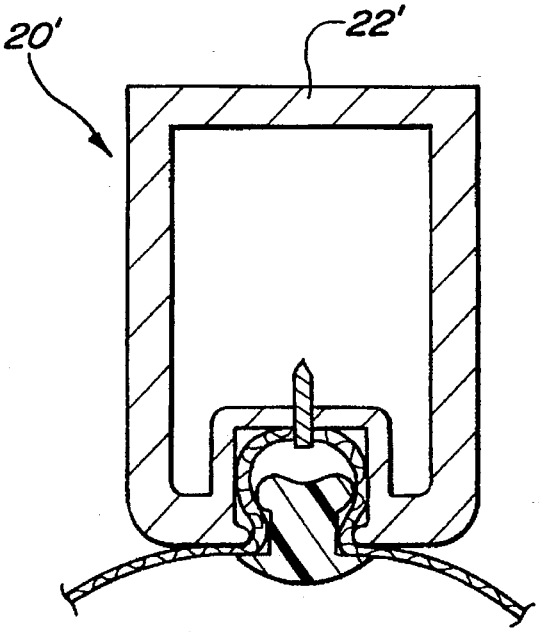
FIG. 2 is a rectangular embodiment of the frame shown in FIG. 1.

With reference to FIG. 2, an alternate shape of the channelled member 22 of FIG. 1 is illustrated here as channelled member 22'. The member 22', shown in cross section, discloses a substantially rectangular shape. In other respects the assembly 20' of FIG. 2 is the same as that shown in FIG. 1 and discussed in relation thereto.

Figure 3:
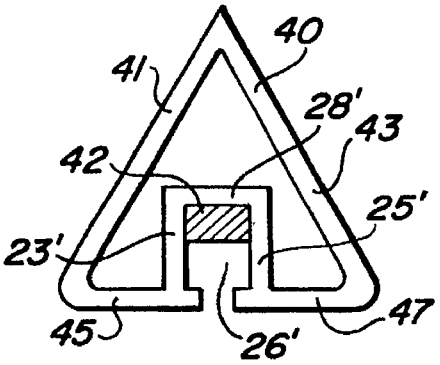
FIG. 3 is an alternate embodiment of the frame member of the present invention shown in cross section.

With reference to FIG. 3, an alternate embodiment of the frame member according to the present invention is shown. A channelled frame member 40 is shown in cross section, thus revealing its triangular shape. A channel 26' is defined therein having a channel base 28'. The channel 26' is defined by a first channel wall 23' and a second channel wall 25' whereby the channel base 28' is disposed therebetween. The outer structure of the channeled frame member 40 includes a first side member 41 interconnecting at one edge a second side member 43. Inter-connecting the first channel wall 23' and the first side wall 41 is a first adjacent wall 45. Interconnecting the second channel wall 25' and the second side wall 43 is a second adjacent wall 47.

Like the channelled member 22 discussed above relative to FIG. 1, the channelled member 40 may be composed of aluminium or steel If the preferred material is steel, staples may not be conventionally drivable through the base 28' of the channelled member 40. Accordingly, a strip 42 of vinyl or a similar material is provided in the channel 26' for receiving staples or the like.

Figure 4:
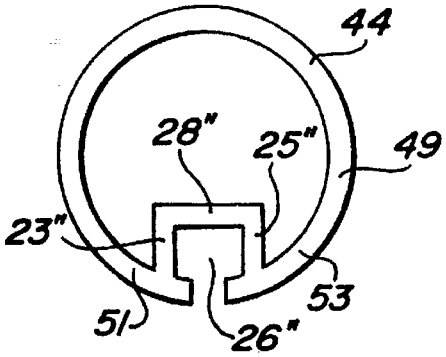
FIG. 4 is another alternate embodiment of the frame member of the present invention shown in cross section.

Referring to FIG. 4, another embodiment of the frame member according to the present invention is shown indicated by 44. The channelled frame member 44 is shown in cross section, thereby disclosing its substantially round shape. A channel 26" is defined therein by a first channel wall 23" and a second channel wall 25" whereby a channel base 28" is disposed therebetween. The outer structure of the channeled member 44 includes a round body wall 49 having a first adjacent wall portion 51 which interconnects the first channel wall 23" and a second adjacent wall portion 53 which interconnects the second channel wall 25".

Figure 5:
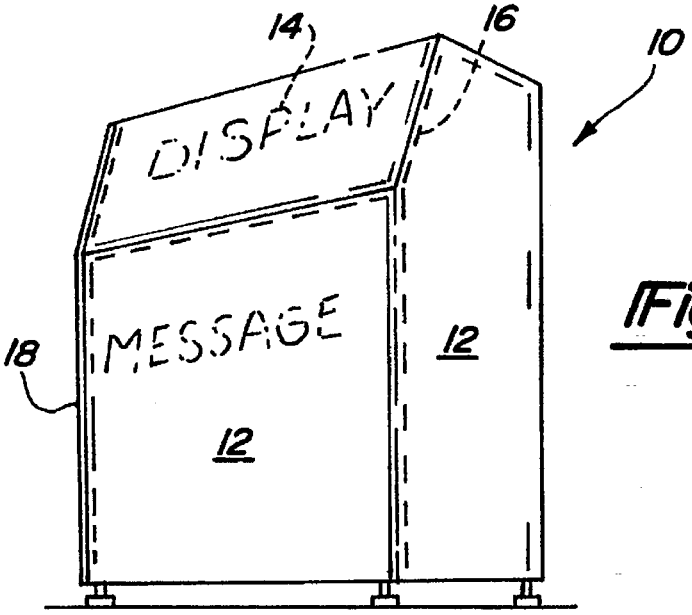
FIG. 5 is a perspective view of a construction assembly according to the present invention employing the frame structure embodied in FIG. 1.

Referring to FIG. 5, there is shown a preferred embodiment of a construction assembly for a closure used as a display according to the present invention, generally indicated by 10. The display 10 is here used as a medium for display which is lightweight and easily constructed. The display includes a covering portion 12 which may include a picture or words 14. An internal frame 16 is indicated by broken lines having a number of trim pads 18 attached thereto.

Figure 6:
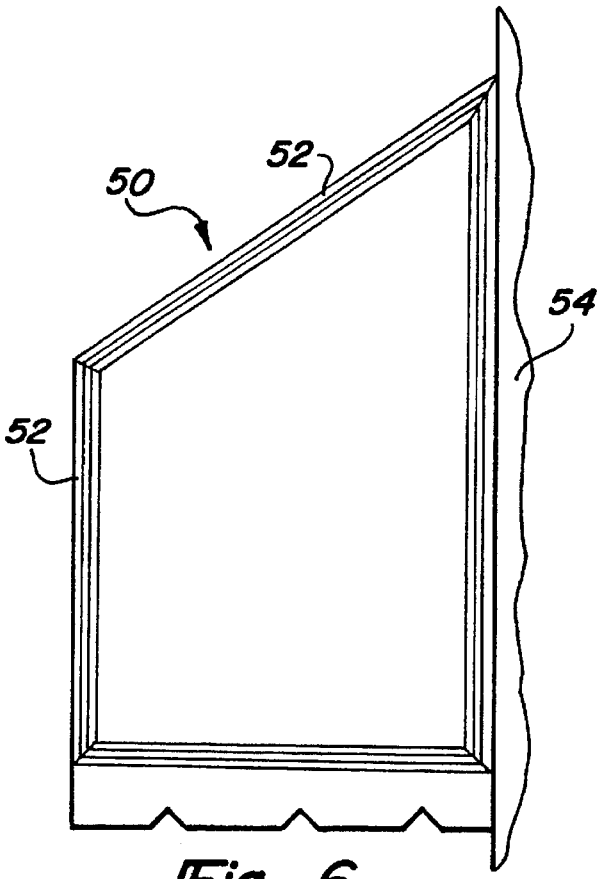
FIG. 6 is a side view of another construction assembly employ the frame structure embodied in FIG. 1.

With reference to FIG. 6, a side view of a suggested closure according to the present invention is shown. The closure illustrated is generally fashioned to function as an awning assembly generally indicated by 50, although it may be formed as a canopy, a boat cover, a roof, or the like.

The closure 50 comprises channelled members 22 (of FIG. 1), 40 (of FIG. 3), or 44 (of FIG. 4) which are welded together to form a frame. The closure 50, as illustrated, attaches to a wall structure 54.

Figure 7:
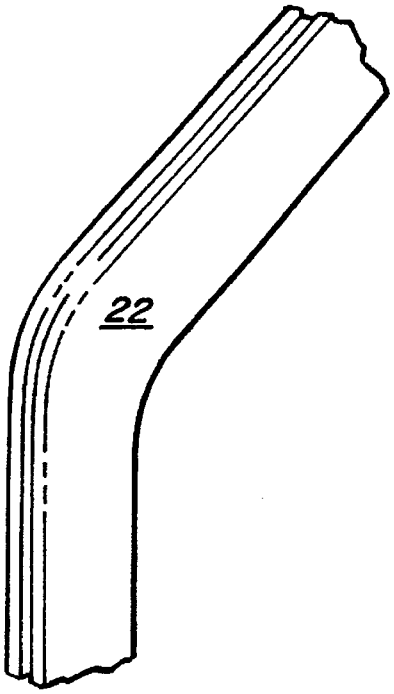
FIG. 7 is a partial perspective view of the member shown in FIG. 1 having an arcuate shape.

With reference to FIG. 7, a portion of the channelled member 22 of FIG. 1 is shown in detail. As shown, the channelled member 22 is bent to illustrate its versatility of application. While the channelled member 22 is bent at an angle greater than 90, the degree of angle may produce a radius as small as six inches.

Figure 8:
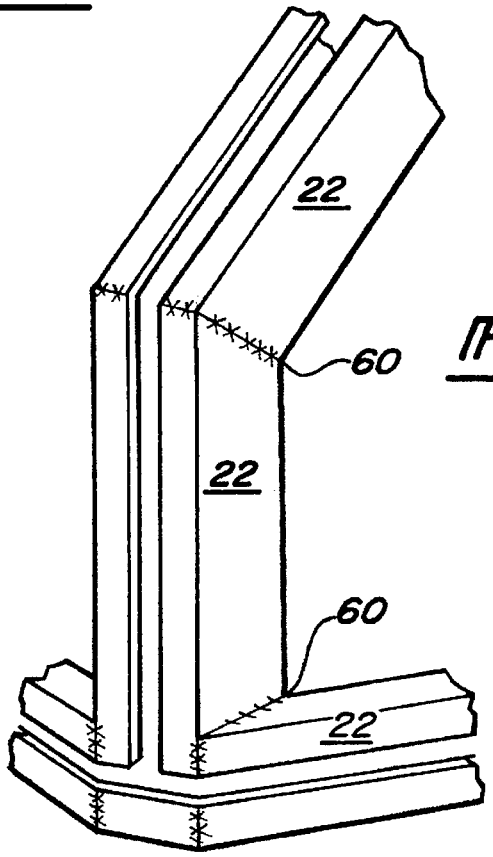
FIG. 8 is a partial perspective view of joined members of the embodiment of the present invention shown in FIG. 1.

Referring to FIG. 8, a number of channelled members 22 of FIG. 1 are shown welded together to further illustrate the versatility of the present invention. The channelled members 22 are abutted against one another at joints 60. The channelled members 22 may be joined by welding (as illustrated) or by interlocking with hinged fasteners (not shown). The degree of angle may be varied, virtually without limitation, from the degrees shown.

Referring to FIG. 9, a sectional view of an awning assembly generally indicated by 70 is shown. The awning 70 is covered by a material 32. The awning 70, which may also be structured as a canopy or a roof structure, comprises a number of arcuately formed channelled members 22 as illustrated above in FIG. 1. Of course, the channelled members 40 (of FIG. 3) or 44 (of FIG. 4) may be used in the alternative or in combination. Due to the flexibility of the channelled members 22 accorded because of their square-shaped, single-chambered design as discussed above with respect to FIG. 1, the arcuate form illustrated can be achieved. The material 32 is fastened to the channelled members 22 by means of staples (not shown) and a tight seal is made by insertion of the flexible trim pads 36.

Referring to FIG. 10, there is shown in cross section an assembled view of an alternate construction of the present invention.

The assembly, generally indicated as 100, comprises a substantially hollow, square-shaped channelled member 122. The channel member shape may, of course, be square, rectangular, triangular, or round as discussed above with respect to the members 22, 22', 40 and 44 as shown in FIGS. 1, 2, 3 and 4 respectively. The square-shaped embodiment includes a channel 126 defined in one side of the member 122, and is defined by a first channel wall 123 and a second channel wall 125 whereby a channel base is disposed therebetween. The outer structure of the channelled member 122 includes a first side member 127, a second side member 129 and a base member 131 disposed therebetween.

Interconnecting the first channel wall 123 and the first side member 127 is a first adjacent wall 133. Interconnecting the second channel wall 125 and the second side member 129 is a second adjacent wall 135.

The embodiment according to FIG. 10 includes as a modification of the basic member a cantilevered flange 137 The flange 137 is substantially an extension of the second adjacent wall 135. The flange 137 is preferably planar and elongated and may, in its preferred construction, run the length of the member 122. Of course, the flange 137 may be disposed in alternate positions on the member 122 (not shown), and, as a further alternative, a plurality of flanges may be provided (not shown). For example, an additional flange may be extended from the adjacent wall 133.

Referring to FIG. 11, an alternate shape of the assembly 100 illustrated in FIG. 10 is illustrated and is generally indicated as 150. The assembly 150 includes a rectangularly-shaped elongated member 152. This construction may be preferred for added strength, but in other respects the assembly 150 is identical to that of assembly 100 two coplanar flanges 138, 138 are located on the assembly 150 which has an elongated member 152.

In summary, a construction assembly for closures such as awnings, canopies, roofs, displays, or boat coverings and the like is assembled by first establishing a frame structure using one (or more) of channelled members 22, 40 or 44 depending on preference. Thereafter, a selected portion of the covering material 32 is laid over the established frame. A small excess of material 32 is forced into the channel of the selected member and is loosely fitted therein. The material is thereafter anchored into the channels by driving anchoring staples 34 through the material 32. Thereafter, the trim pads 36 are force fitted into the channels.

Having set forth the present invention and what is considered to be the best embodiments thereof, it will be understood that changes may be made from the specific embodiments set forth without departing from the spirit of the invention or exceeding the scope thereof as defined in the following claims.

We claim:

1. A construction assembly, comprising:

a plurality of substantially elongated framing members, said framing members each having defined therein at least one longitudinal channel, said channel being defined by a first channel wall, a second channel wall, and a channel base disposed therebetween and connected with said channel walls;

a covering material;

means for anchoring said covering material into said channels of said framing members, said means comprising a plurality of staples;

a plurality of flexible elongated trim pads having at least two coplanar slots defined therein, said elongated trim pads adapted to be fixed into said channels thereby substantially locking said covering material therein and forming a tight seal thereby;

each of said framing members being hollow and having an outer periphery which is substantially square shaped in cross-section;

at least one flange extending from each of said framing members, said flange extending substantially parallel to said channel base;

said substantial square shape being defined by a first side member, a second side member and a base member joining the side members together in parallel relationship along an edge of each of said side members to define a framing member having a pair of spaced elongated parallel extending side members joined together by a substantially perpendicularly extending elongated base member to thereby form an elongated slot;

said first channel wall, said second channel wall and said channel base being formed within said framing member slot with said channel base spaced inwardly from and extending substantially parallel to said base member.

2. The construction assembly according to claim 1 wherein said staples are substantially driven into said channel base.

3. The construction assembly according to claim 1 wherein said channel base is overlaid with a polymerized material.

4. The construction assembly according to claim 1 wherein each of said elongated framing members has four sides.

5. The construction assembly according to claim 4 wherein each of said elongated framing members is rectangular shaped in cross-section.

6. The construction assembly according to claim 1 wherein at least one of said framing members is provided with two flanges, said flanges being coplanar.

* * * * *